US011849898B2

(12) United States Patent
Narayana Pillai et al.

(10) Patent No.: US 11,849,898 B2
(45) Date of Patent: Dec. 26, 2023

(54) DISHWASHER WITH DOOR ASSEMBLY

(71) Applicant: WHIRLPOOL CORPORATION, Benton Harbor, MI (US)

(72) Inventors: Ajay Ram Narayana Pillai, St. Joseph, MI (US); Priyanka Popat Mali, Satara (IN); Eric John Walsh, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 49 days.

(21) Appl. No.: 17/412,718

(22) Filed: Aug. 26, 2021

(65) Prior Publication Data

US 2023/0061769 A1 Mar. 2, 2023

(51) Int. Cl.
*A47L 15/42* (2006.01)

(52) U.S. Cl.
CPC ..... *A47L 15/4263* (2013.01); *A47L 15/4293* (2013.01)

(58) Field of Classification Search
CPC ..... A47L 15/4257; A47L 15/4293
See application file for complete search history.

(56) References Cited

U.S. PATENT DOCUMENTS 3,068,877 A * 12/1962 Jacobs ..... A47L 15/483 134/108
3,627,165 A * 12/1971 Cobb ..... F25D 23/085 220/592.08
4,137,354 A * 1/1979 Mayes, Jr. ..... B29C 70/382 428/36.1
4,765,697 A 8/1988 Gardell et al.
5,992,954 A 11/1999 Becker
9,427,134 B2 8/2016 Fetzer et al.
9,439,552 B2 9/2016 Fischer et al.
2004/0201337 A1* 10/2004 Wuestefeld ..... A47L 15/4265 312/311
2007/0042156 A1* 2/2007 Rockwell ..... B26F 1/22 428/116
2008/0196750 A1* 8/2008 Yoo ..... A47L 15/4265 49/169
2008/0223421 A1* 9/2008 Rosenbauer ..... A47L 15/4246 264/261
2009/0038653 A1* 2/2009 Kang ..... A47L 15/488 134/105

(Continued)

FOREIGN PATENT DOCUMENTS

CN 1816260 A * 8/2006
CN 107854099 A * 3/2018 ..... A47L 15/4257

(Continued)

*Primary Examiner* — Joseph L. Perrin
*Assistant Examiner* — Irina Graf
(74) *Attorney, Agent, or Firm* — McGarry Bair PC

(57) ABSTRACT

A dishwasher for treating dishes according to a cycle of operation, the dishwasher comprising a tub at least partially defining a treating chamber having an open face for receiving dishes a door assembly movable between opened and closed positions the door assembly comprising a door panel, a pocket handle defining a pocket width and proximate the top of the door panel for selectively opening and closing the open face of the tub, and a console coupled to the top of the door panel and comprising an isogrid structure at a location proximate the pocket handle.

20 Claims, 15 Drawing Sheets

(56) References Cited

U.S. PATENT DOCUMENTS

| | | | | |
|---|---|---|---|---|
| 2009/0288692 | A1* | 11/2009 | Haeberle | A47L 15/4257 29/428 |
| 2010/0139717 | A1* | 6/2010 | Olesen | A47L 15/4257 29/700 |
| 2010/0187958 | A1* | 7/2010 | Colon | A47L 15/4209 312/228 |
| 2011/0192430 | A1* | 8/2011 | Baldwin | A47L 15/4257 134/137 |
| 2011/0232701 | A1* | 9/2011 | Colon | A47L 15/4246 134/198 |
| 2011/0247276 | A1* | 10/2011 | Egger | A47L 15/4257 49/460 |
| 2013/0300268 | A1* | 11/2013 | Schaefer | A47L 15/4265 49/70 |
| 2017/0096837 | A1* | 4/2017 | Criner | E05B 1/0015 |
| 2017/0159351 | A1* | 6/2017 | Kim | A47L 15/4265 |
| 2017/0188787 | A1* | 7/2017 | Min | A47L 15/488 |
| 2017/0280964 | A1* | 10/2017 | Ponkshe | A47L 15/4293 |
| 2019/0059693 | A1* | 2/2019 | Kendall | A47L 15/4261 |
| 2020/0060509 | A1* | 2/2020 | Ponkshe | A47L 15/4293 |
| 2020/0113408 | A1* | 4/2020 | Ford, Jr. | A47L 15/4257 |
| 2020/0165765 | A1* | 5/2020 | Meyer | A47L 15/4253 |
| 2020/0337521 | A1* | 10/2020 | Kim | A47L 15/4261 |
| 2021/0100423 | A1 | 4/2021 | Ploszaj et al. | |

FOREIGN PATENT DOCUMENTS

| | | | | | |
|---|---|---|---|---|---|
| CN | 108272423 | A | * | 7/2018 | A47L 15/0084 |
| CN | 112369994 | A | * | 2/2021 | A47L 15/00 |
| DE | 19907233 | A1 | * | 8/2000 | A47L 15/4257 |
| DE | 102011008722 | A1 | * | 7/2012 | F25D 23/02 |
| DE | 102011079229 | A1 | * | 1/2013 | B29C 45/0053 |
| DE | 202014000853 | | | 6/2015 | |
| DE | 102019128846 | A1 | * | 4/2021 | D06F 39/02 |
| EP | 925753 | A1 | * | 6/1999 | A47L 15/42 |
| EP | 1723891 | A1 | | 11/2006 | |
| EP | 2514350 | A1 | * | 10/2012 | A47L 15/4257 |
| EP | 2703724 | A1 | * | 3/2014 | F24C 7/086 |
| FR | 2977900 | A1 | * | 1/2013 | A47L 15/4257 |
| JP | 2010035952 | A | * | 2/2010 | |
| KR | 20070088868 | A | * | 8/2007 | A47L 15/42 |
| KR | 20100095821 | A | * | 9/2010 | |
| WO | WO-2019128319 | A1 | * | 7/2019 | |
| WO | WO-2020101418 | A1 | * | 5/2020 | A47L 15/4257 |
| WO | WO-2020224863 | A1 | * | 11/2020 | |

* cited by examiner

DISHWASHER WITH DOOR ASSEMBLY

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. At least one rack or basket, generally referred to as a dish rack, for supporting soiled dishes can be provided within the tub. A silverware or utensil basket for holding utensils, silverware, cutlery, and the like, may also be provided and is generally removably mounted to the door or within the dish rack.

Any one of the soiled dishes or utensils, silverware, cutlery, and the like, can be positioned for cleaning in the dish rack. In some cases when moving the dish rack in and out of the dishwasher, one of the soiled dishes or utensils, silverware, cutlery, and the like, can hit, become stuck by or otherwise interact with the sprayer making movement into the dishwasher difficult or cease for the dish rack. Inconveniently, users have to remove the dish rack, inspect the dish rack for the dish causing an interaction, reposition or remove the dish and attempt to move the dish rack back into the dishwasher.

BRIEF DESCRIPTION

The disclosure relates to a dishwasher for treating dishes according to a cycle of operation, the dishwasher comprising a tub at least partially defining a treating chamber having an open face for receiving dishes a door assembly movable between opened and closed positions the door assembly comprising a door panel having an inner panel surface facing the treating chamber when the door assembly is in the closed position, spanning between a top and a bottom and between opposing sides, and having a set of top flanges extending from the top of the door panel; a pocket handle defining a pocket width and proximate the top of the door panel for selectively opening and closing the open face of the tub; a console having at least one tab coupled to the set of top flanges with a fastener; and a grid structure integral with the console at a location proximate the pocket handle.

Another aspect of the disclosure relates to a dishwasher for treating dishes according to a cycle of operation, the dishwasher comprising a tub at least partially defining a treating chamber having an open face for receiving dishes a door assembly movable between opened and closed positions the door assembly comprising a door panel having an inner panel surface facing the treating chamber when the door assembly is in the closed position, spanning between a top and a bottom and between opposing sides, and having a set of side flanges extending from at least one of the opposing sides at the top of the door panel, a pocket handle defining a pocket width and proximate the top of the door panel for selectively opening and closing the open face of the tub, a console having at least one end mount coupled to the set of side flanges with a fastener; a grid structure integral with the console at a location proximate the pocket handle.

Another aspect of the disclosure relates to a dishwasher for treating dishes according to a cycle of operation, the dishwasher comprising a tub at least partially defining a treating chamber having an open face for receiving dishes a door assembly movable between opened and closed positions the door assembly comprising a door panel having an inner panel surface facing the treating chamber when the door assembly is in the closed position, spanning between a top and a bottom and between opposing sides, a pocket handle defining a pocket width and proximate the top of the door panel for selectively opening and closing the open face of the tub, and a console coupled to the top of the door panel and comprising an isogrid structure at a location proximate the pocket handle.

DETAILED DESCRIPTION

Figure 1:
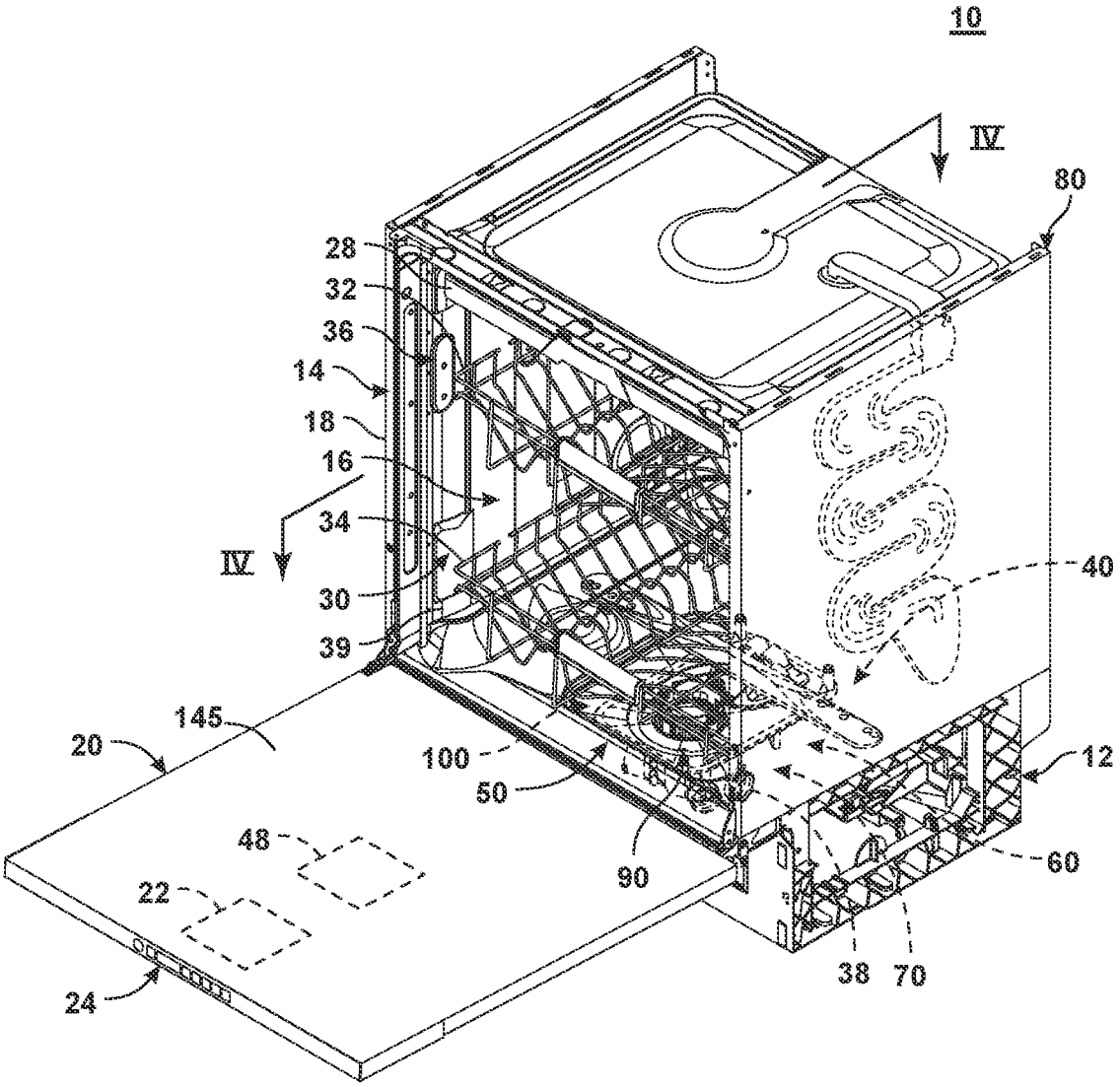
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items. While illustrated as a single panel, multiple parts can together define the door assembly 20.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 63. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
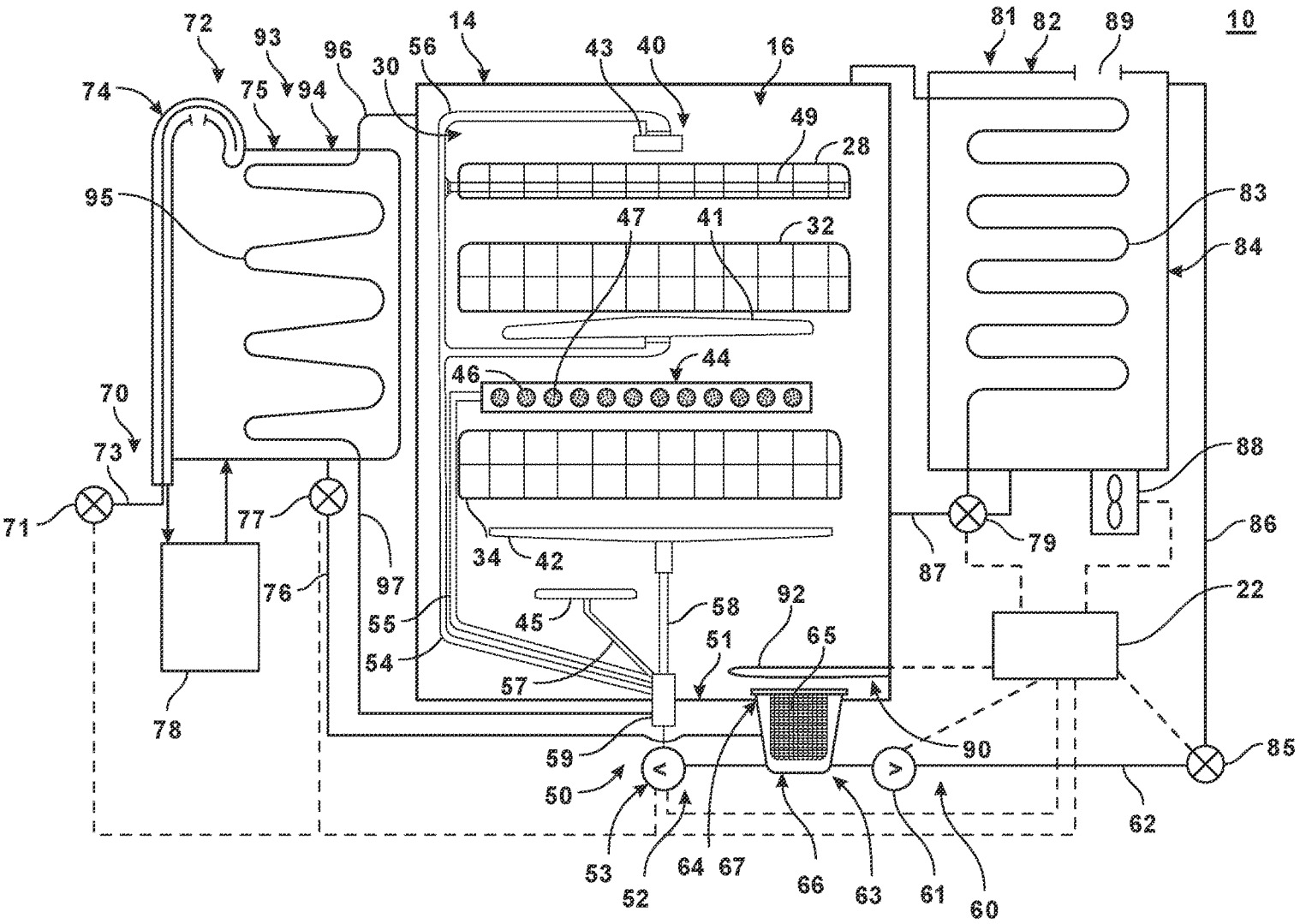
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 49 can be located at least in part below a portion of the third level rack 28. The sprayer 49 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher-pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 43, 44, 45, 49 to the recirculation pump 53. A recirculation valve 59 can selectively fluidly couple each of the conduits 54-58 to the recirculation pump 53. While each sprayer 43, 44, 45, 49 is illustrated as having a corresponding dedicated supply conduit 54-58 one or more subsets, comprising multiple sprayers from the total group of sprayers 43, 44, 45, 49, can be supplied by the same conduit, negating the need for a dedicated conduit for each sprayer. For example, a single conduit can supply the upper spray arm 41 and the third level sprayer 43. Another example is that the sprayer 49 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 61 fluidly coupled the treating chamber 16 to a drain line 62. As illustrated the drain pump 61 fluidly couples the sump 51 to the drain line 62.

While separate recirculation and drain pumps 53 and 62 are illustrated, a single pump can be used to perform both the recirculating and the draining functions. Alternatively, the drain pump 61 can be used to recirculate liquid in combination with the recirculation pump 53. When both a recirculation pump 53 and drain pump 61 are used, the drain pump 61 is typically more robust than the recirculation pump 53 as the drain pump 61 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 61. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 62 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 61, drain line 62, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 62 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be considered when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 63 is provided to filter un-dissolved solids from the liquid in the treating chamber 16. The filter system 63 includes a coarse filter 64 and a fine filter 65, which can be a removable basket 66 residing the sump 51, with the coarse filter 64 being a screen 67 circumscribing the removable basket 66. Additionally, the recirculation system 50 can include a rotating filter in addition to or in place of the either or both of the coarse filter 64 and fine filter 65. Other filter arrangements are contemplated such as an ultrafiltration system.

Figure 3:
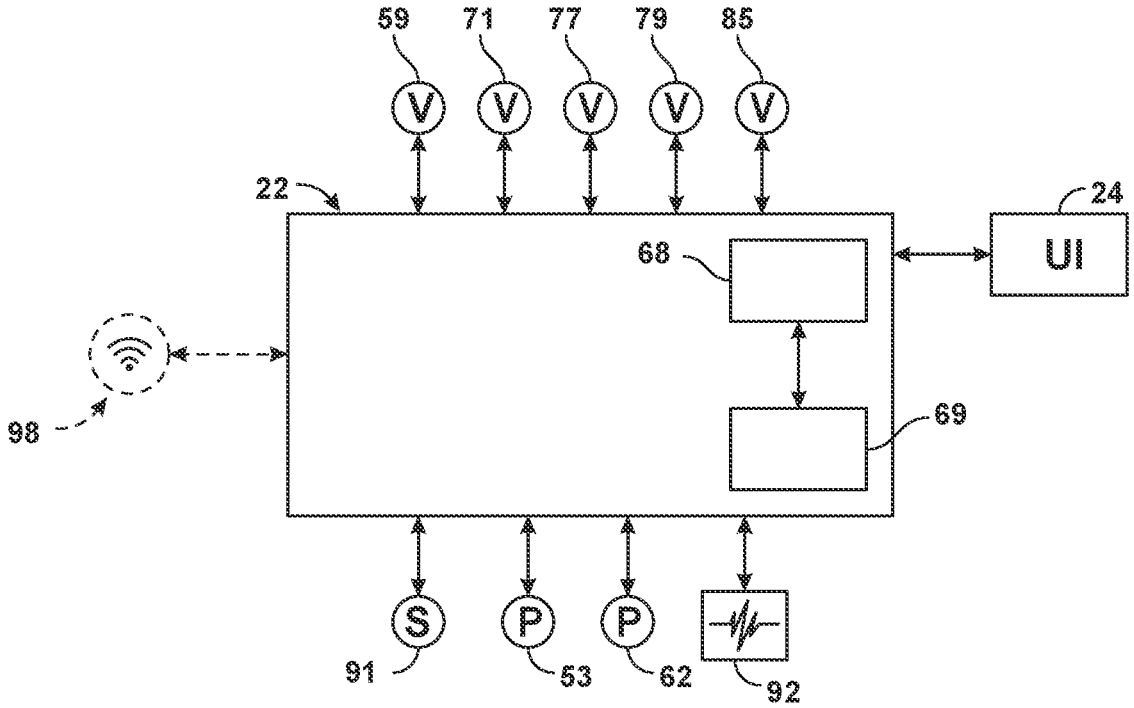
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 61 for draining liquid from the treating chamber 16, and the recirculation pump 53 for recirculating the wash liquid during the cycle of operation. The controller 22 can be provided with a memory 68 and a central processing unit (CPU) 69. The memory 68 can be used for storing control software that can be executed by the CPU 69 in completing a cycle of operation using the dishwasher 10 and any additional software. For example, the memory 68 can store one or more pre-programmed automatic cycles of operation that can be selected by a user and executed by the dishwasher 10. The controller 22 can also receive input from one or more sensors 91. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 98.

Figure 4:
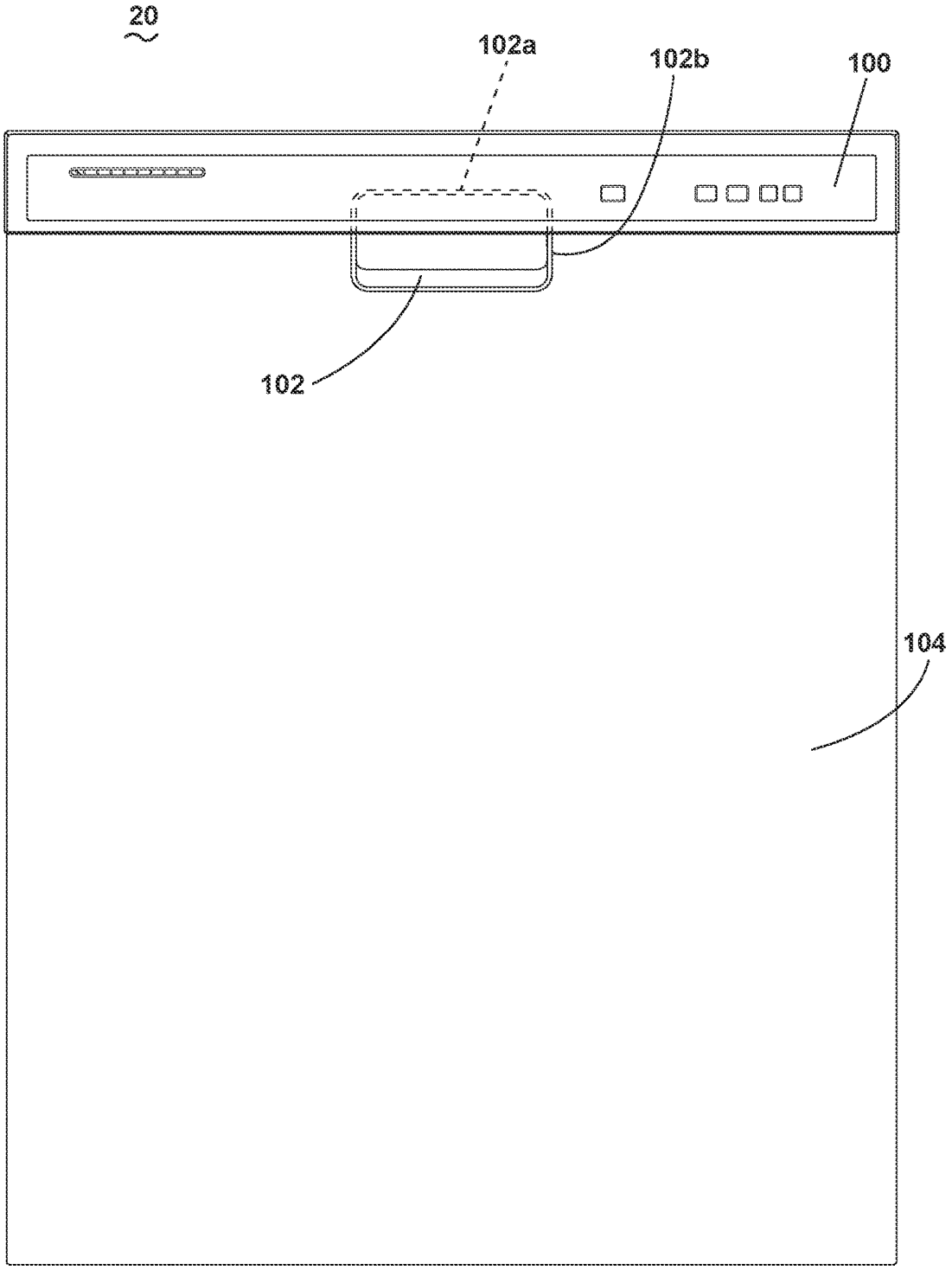
FIG. 4 is a front view of a door assembly for the dishwasher of FIG. 1 according to an aspect of the disclosure herein.

FIG. 4 is a front view of the door assembly 20 according to an aspect of the disclosure herein. The door assembly 20 can include, among other things, a console 100, a pocket handle 102, and a door panel 104. Each of the console 100, pocket handle 102, and door panel 104 can be separate pieces coupled to each other during assembly to define the door assembly 20 for accessing the dishwasher 10. It is further contemplated that the pocket handle 102 can be formed with the door panel 104 as one piece. A cap portion 102*a* can extend behind the console 100 as illustrated in dashed line. A pocket portion 102*b* together with the cap portion 102*a* can define the pocket handle 102. The pocket handle 102 is illustrated as an oblong rounded shape, it should be understood, however, that the pocket handle 102 can be any suitable shape enabling a user to grasp the pocket handle 102 in order to move the door assembly 20 between the opened and closed positions.

Figure 5:
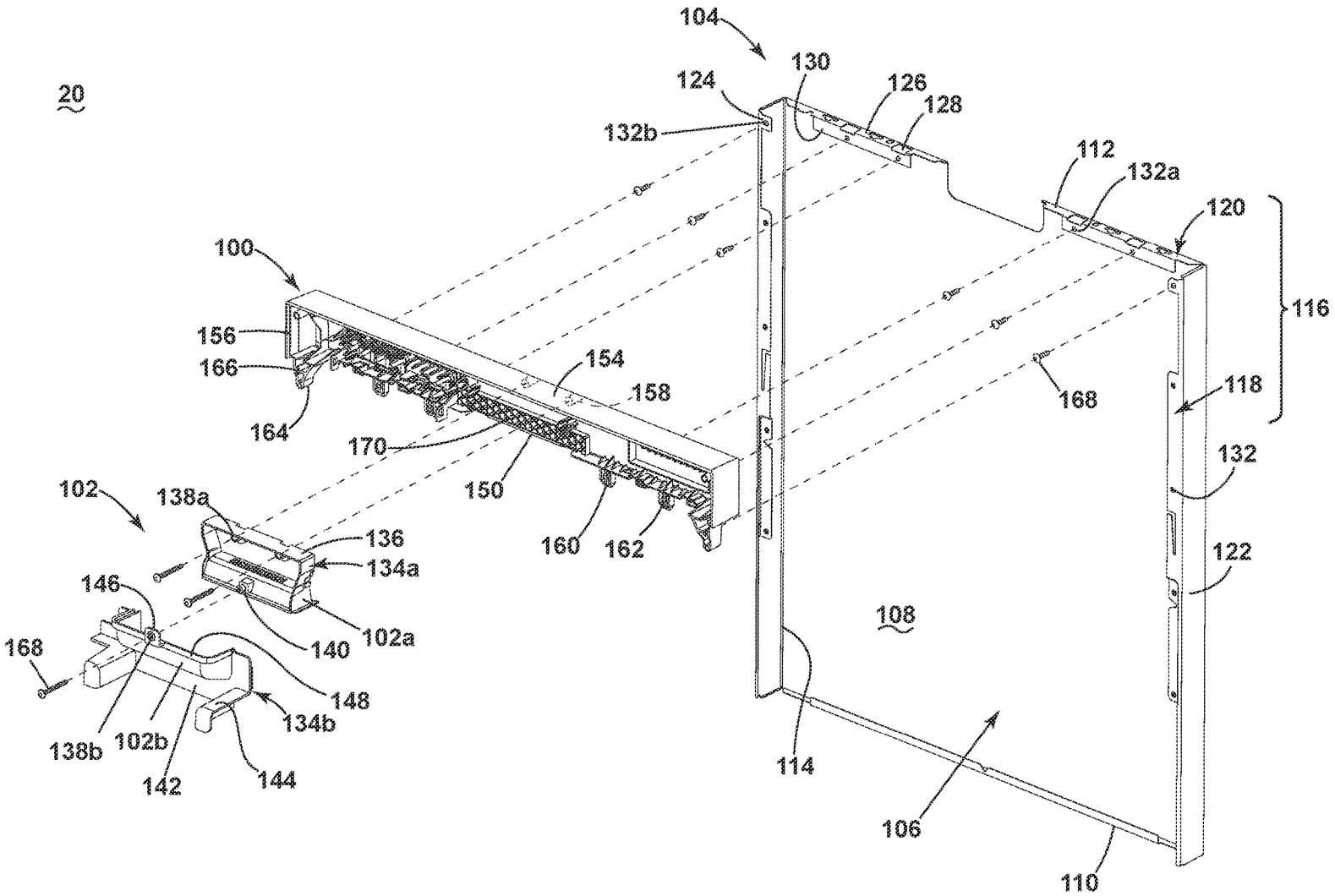
FIG. 5 is an exploded view of the door assembly from FIG. 4 including a door panel, a console, and a pocket handle.

FIG. 5 is an exploded view of the door assembly 20 illustrating an interior view of the console 100, the pocket handle 102, and the door panel 104. It should be understood that while not illustrated, other components can be included in the door assembly 20, and are not shown for clarity.

The door panel 104 can include an inner panel surface 106 defining a plane 108 facing the treating chamber 16 when the door assembly 20 is in the closed position. It is contemplated that an additional part can be formed or attached to the inner panel surface 106 before assembly such that the inner panel surface 106 as illustrated is not necessarily the surface to which other parts are attached or mounted to. The inner panel surface 106 can span from a bottom 110 of the door panel 104 to a top 112 of the door panel 104 and between opposing sides 114. The bottom 110 of the door panel 104 can define a bottom of the door assembly 20 where the door assembly is pivotally mounted to the base 12. A set of flanges 116 can extend from the inner panel surface 106 for mounting with other components of the door assembly 20. The set of flanges 116 can include, but is not limited to, a set of side flanges 118 and a set of top flanges 120.

The door panel 104 can include sidewalls 122 extending toward the treating chamber 16 from the opposing sides 114. The set of side flanges 118 can extend from the sidewalls 122 in a direction generally parallel to the plane 108. The set of side flanges 118 can include at least one top side flange 124 illustrated as a pair of top side flanges, one extending from each of the sidewalls 122.

The set of top flanges 120 can include a first leg 126 extending toward the treating chamber 16. The first leg 126 can extend in a direction generally perpendicular to the plane 108. The first leg 126 can include at least one opening 128. A second leg 130 can extend from the first leg 126 toward the bottom 110. The second leg 130 can extend in a direction generally parallel to the plane 108. A set of flange holes 132 can be located in the set of flanges 116. By way of non-limiting example, a first set of flange holes 132*a* can be located in the set of top flanges 120 and a second set of flange holes 132*b* can be located in the at least one top side flange 124.

A pocket handle assembly 134 can include first and second parts 134*a*, 134*b*. The first part 134*a* can be a singular piece including the cap portion 102*a*. A mounting frame 136 can extend upwards from the cap portion 102*a*. A first set of pocket holes 138*a* can be located in an uppermost portion of the mounting frame 136. A first set of mounting holes 140, by way of non-limiting example a single mounting hole, can be located at a central bottom portion of the cap portion 102*a*.

The second part 134*b* can be a singular piece having a planar portion 142 generally parallel to the plane 108. The pocket portion 102*b* can be a cavity extending toward the treating chamber from the planar portion 142. A set of legs 144 can extend from the planar portion 142 in a direction generally perpendicular to the plane 108 and toward the treating chamber 16. The set of legs 144 can come into surface contact with a panel cover 145 (FIG. 1) of the door assembly 20 to provide additional structural support when closing the door assembly 20. A pocket tab 146 can extend from a rim 148 of the pocket portion 102*b* in a direction generally parallel to the plane 108. The pocket tab 146 can be centrally located with respect to the pocket handle assembly 134. A second set of pocket holes 138*b*, by way of non-limiting example a singular pocket hole 138*b*, can extend through the pocket tab 146.

The console 100 can include an inner console surface 150. The inner console surface 150 can extend in the same plane 108 as the inner panel surface 106. The inner console surface 150 can span from a bottom 152 of the console to a top 154 of the console 100 and between opposing sides 156 of the console 100. The top 154 of the console 100 can define a top of the door assembly 20 movable between the closed and open positions for access to the treating chamber 16. A second set of mounting holes 158 can extend from the inner console surface proximate the top 154 of the console 100. At least one tab 160 can extend from the bottom 152 of the console 100. The at least one tab 160 can be multiple tabs, by way of non-limiting example four tabs as illustrated. The at least one tab 160 can include a third set of mounting holes 162.

The console 100 can further include at least one end mount 164, illustrated as two end mounts extending from the opposing sides 156 of the console 100. The at least one end mount 164 can have a generally triangular shape for stability. The at least one end mount 164 can include a fourth set of mounting holes 166.

When assembled, the at least one tab 160 of the console 100 can be received in the at least one opening 128 of the door panel 104. A suitable fastener 168, by way of non-limiting example a screw, can extend through the first set of flange holes 132*a* and into the third set of mounting holes 162. Another suitable fastener 168 can extend through the second set of flange holes 132*b* and into the fourth set of mounting holes 166. An additional suitable fastener 168 can extend through the first set of pocket holes 138*a* and into the second set of mounting holes 158. Yet another fastener 168 can extend through the second set of pocket holes 138*b* and into the first set of mounting holes 140. While each fastener 168 is illustrated as a screw of similar size, it should be understood that the fasteners 168 can be various size and shapes depending on the holes though which they are received. Furthermore, it should be understood that any number of fasteners is contemplated.

A grid structure 170 can be centrally located along the inner console surface 150. The grid structure 170 can provide structural integrity for the door assembly 20 where the pocket handle 102 is located. The grid structure 170 can extend along the inner console surface 150 a length equal to or greater than a width of the pocket handle 102.

Figure 6:
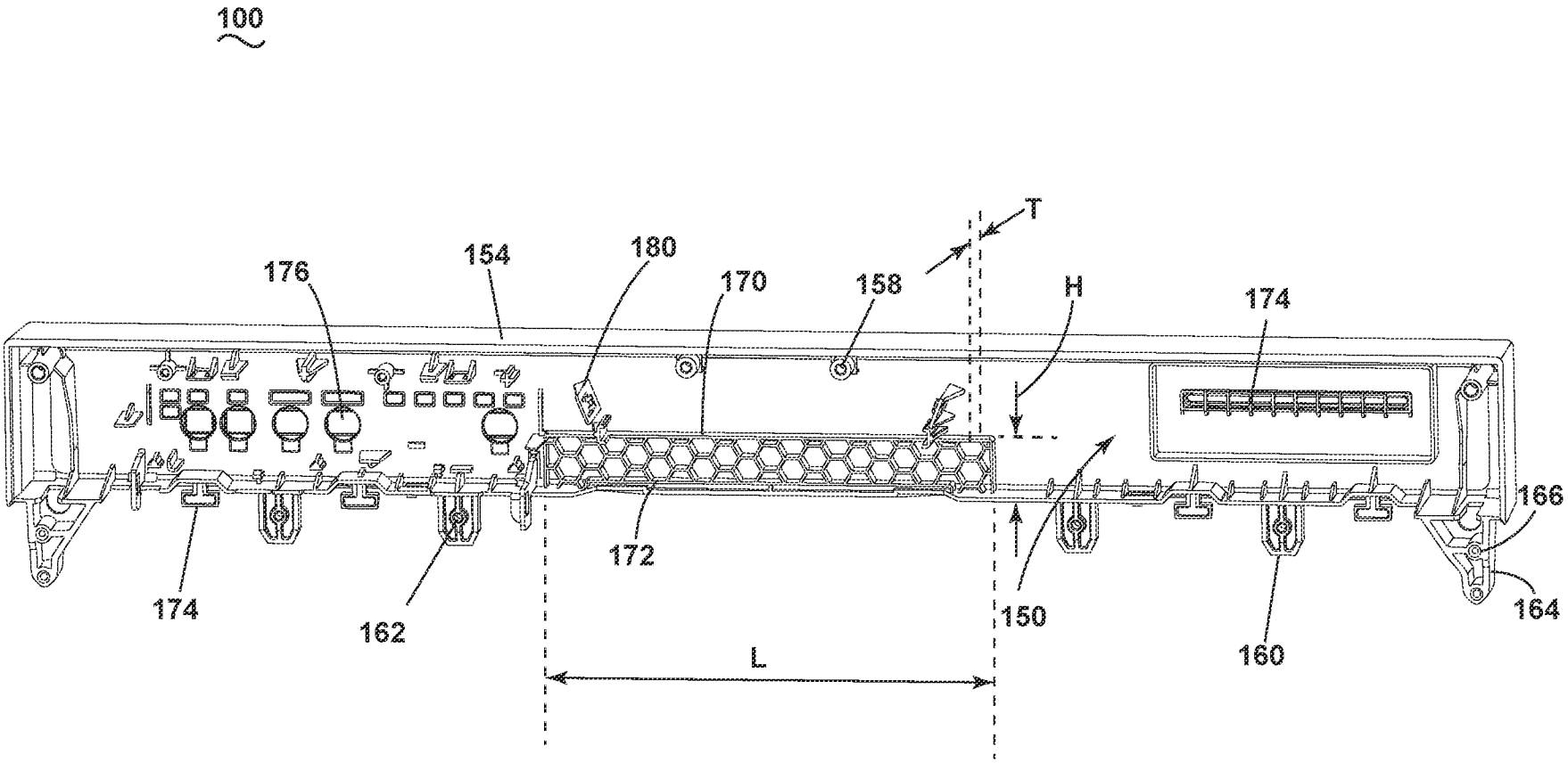
FIG. 6 is an enlarged view of the console from FIG. 5 according to an aspect of the disclosure herein.

FIG. 6 is an enlarged view of the console 100 with a clearer view of the grid structure 170. The grid structure 170 can have a honeycomb pattern. Any tessellation pattern with a repeating shape 172, by way of non-limiting example the hexagon, and no overlaps or gaps can be utilized in the grid structure 170. The grid structure 170 is raised a thickness (T) from the inner console surface 150. The grid structure 170 can extend a length (L) and height (H) along the inner console surface 150. While illustrated as extending about midway between the bottom 152 of the console 100 and the top 154 of the console 100, the height (H) of the grid structure 170 can also extend a full width of the console 100.

It can more clearly be seen that additional tabs 174, by way of non-limiting example T-tabs, can extend from the bottom 152 of the console 100. Access openings 176 for the operational controls associated with the user interface 24 can also be included in the console 100. A vent 178 can also be provided on the console 100.

Additionally, the second set of mounting holes 158 can be more clearly seen. At least one holder 180 can extend from the inner console surface 150. The at least one holder 180 can be multiple holders for receiving the mounting frame 136 to hold the mounting frame 136 in place in tandem with the second set of mounting holes 158.

Figure 7:
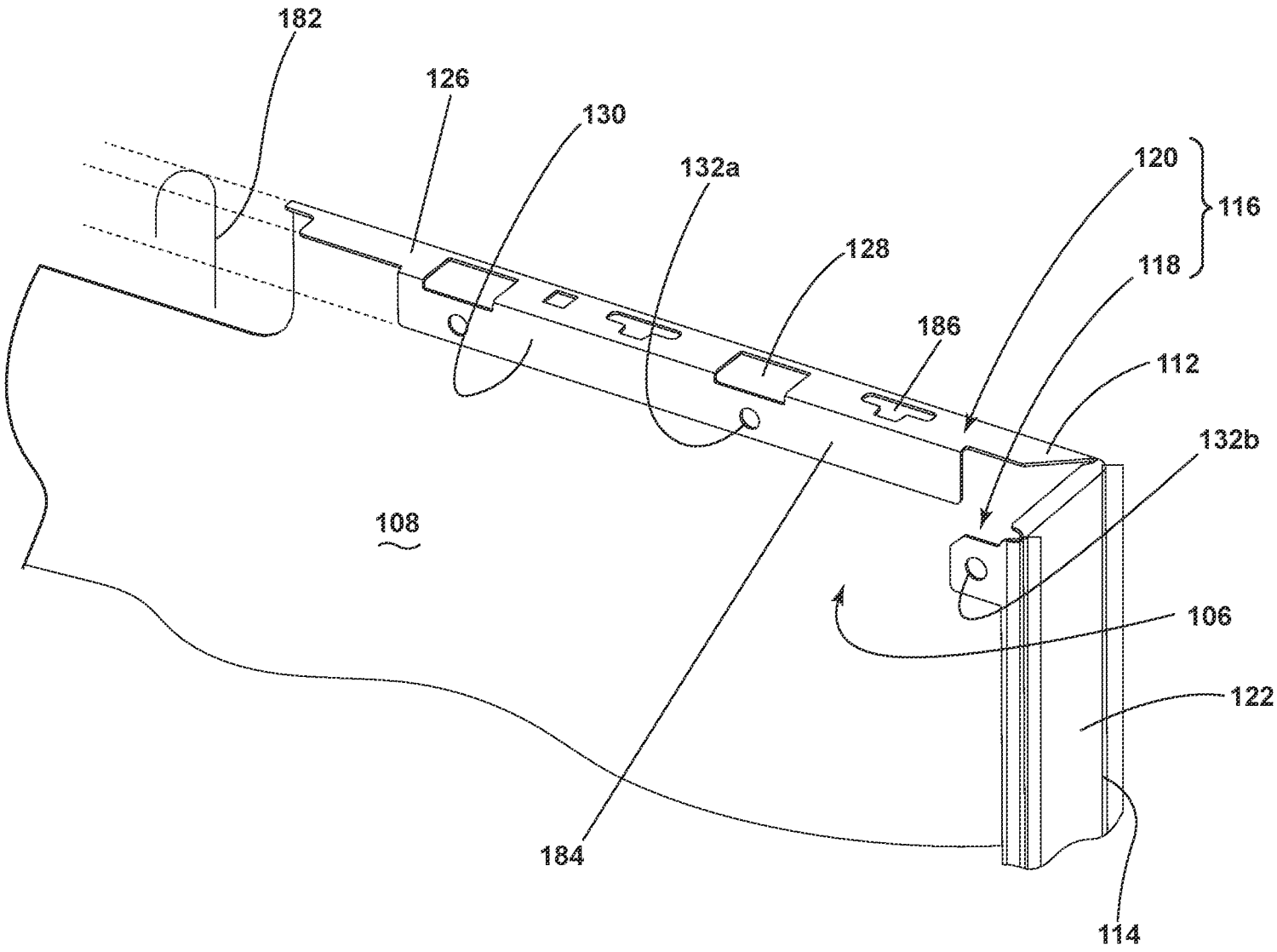
FIG. 7 is an enlarged view of a corner of the door assembly from FIG. 5 according to an aspect of the disclosure herein.

Turning to FIG. 7, an enlarged view of a corner of the door panel 104 is illustrated. It can more clearly be seen that together with the inner panel surface 106, the first and second legs 126, 130 form an upside-down J-shape 182 defining a J-flange 184 open to the bottom 110 of the door panel 104. FIG. 7 more clearly illustrates an additional opening 186 that can be formed in the first leg 126 for receiving the additional tabs 174 (FIG. 6).

Figure 8:
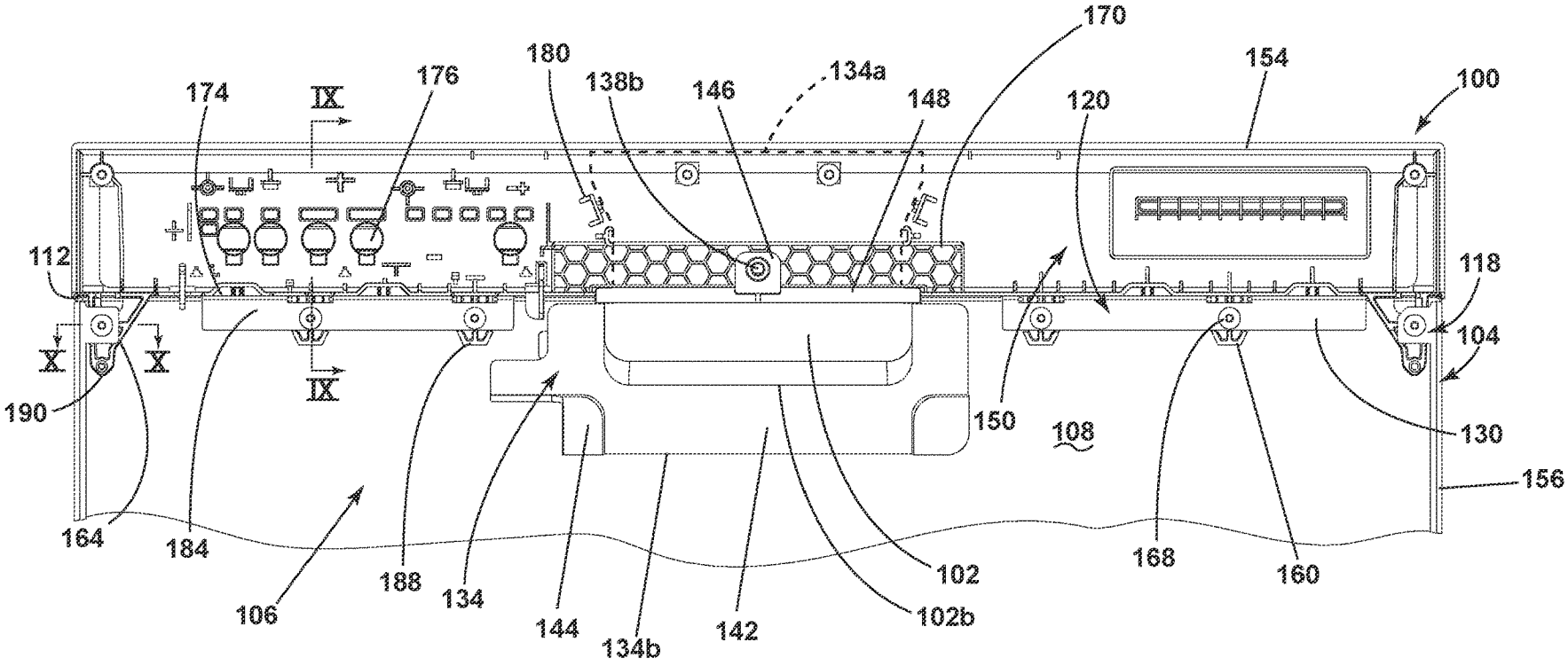
FIG. 8 is an enlarged view of an assembled door assembly from FIG. 5 including the door panel, console, and pocket handle.

FIG. 8 is an assembled view of the console 100, the door panel 104 and the second part 134*b* of the pocket handle assembly 134 with the first part 134*a* illustrated in dashed line. When assembled, it can more easily be seen that the first part 134*a* of the pocket handle assembly 134, in particular the cap portion 102*a*, is sandwiched between the pocket tab 146 and the grid structure 170.

A tip 188 of the at least one tab 160 can extend through the set of top flanges 120, specifically the J-flange 184 as illustrated. The fastener 168 can extend through the first set of flanges hole 132*a* (FIG. 5) into the third set of mounting holes 162 (FIG. 5) to secure the second leg 130 to the at least one tab 160. A corner 190 of the end mount 164 can extend through the set of side flanges 118. The fastener 168 can extend through the second set of flanges hole 132*b* (FIG. 5) into the fourth set of mounting holes 166 to secure the at least one top side flange 124 to the end mount 164.

Figure 9:
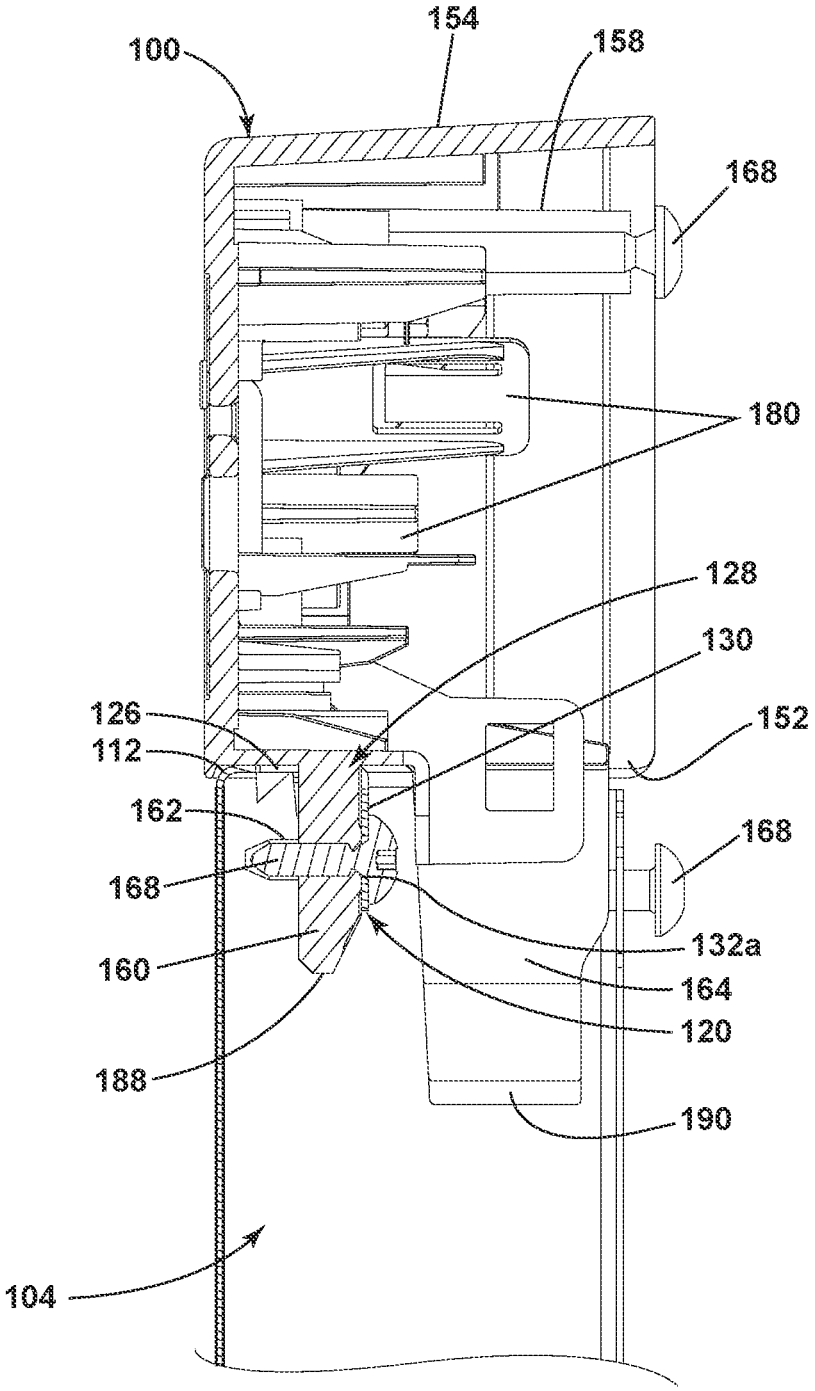
FIG. 9 is a cross-sectional view of the assembled door assembly along line IX-IX from FIG. 8.

FIG. 9 is a cross-sectional view taken along line IX-IX of FIG. 8. It can more clearly be seen that the fasteners 168 described herein can be varying shapes depending on the set of mounting holes 140, 158, 162, 166 they are received in. The second and third set of mounting holes 158, 162 are visible. The pocket handle assembly 134 has been fully removed from the cross-section to more clearly see the end mount 164 orientation with respect to the set of top flanges 120. The orientation of the fastener 168 with respect to the first and second legs 126, 130 of the J-flange 184, along with the J-shape 182 can be more clearly seen as well. Again, the fastener 168 passes through the first set of flange holes 132*a* and then the tab 160 into the third set of mounting holes 162.

Figure 10:
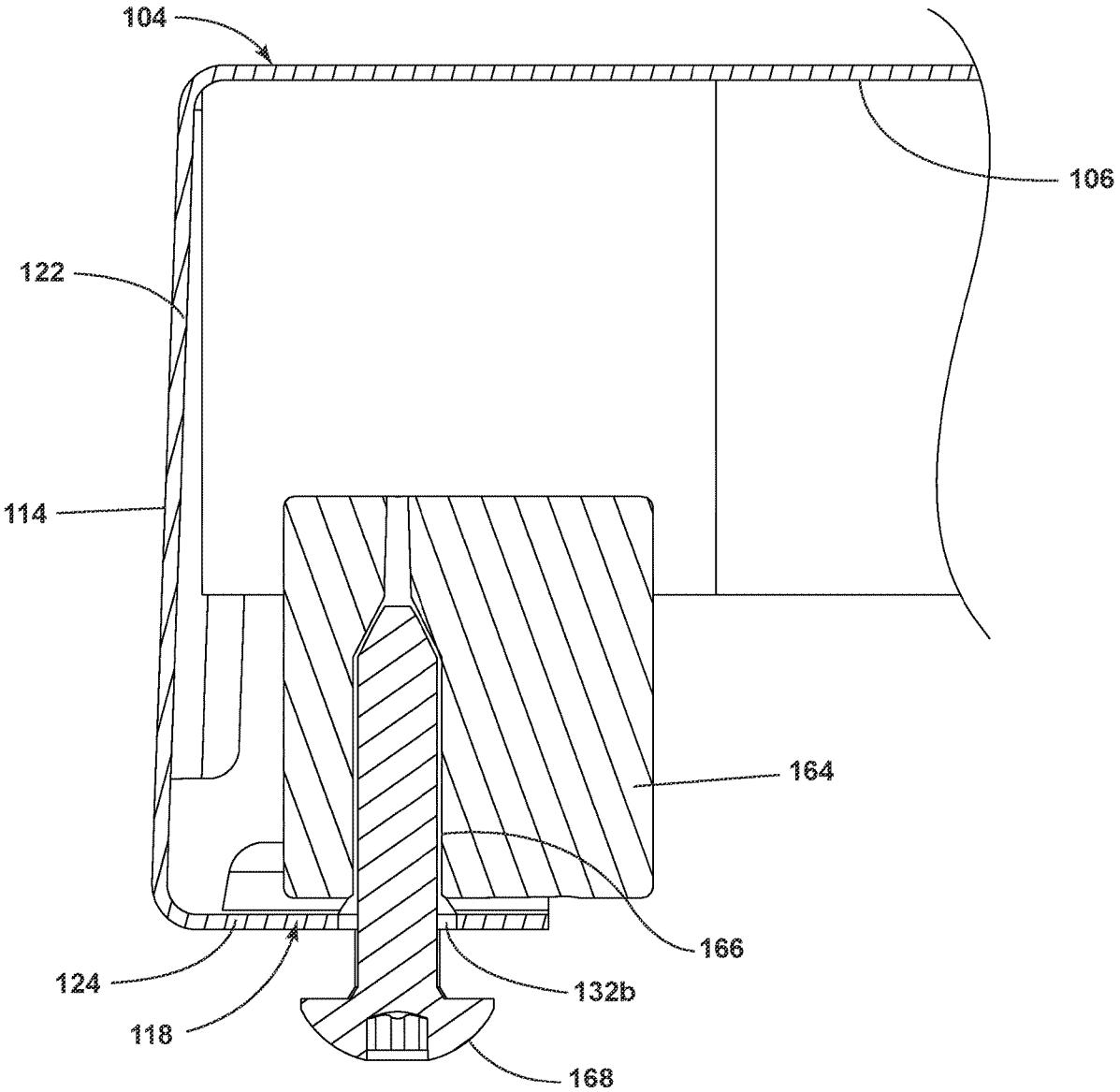
FIG. 10 is a is a cross-sectional view of the assembled door assembly along line X-X from FIG. 8.

FIG. 10 is a cross-sectional view taken along line X-X of FIG. 8. It can more clearly be seen that the fasteners 168 described herein can be varying shapes depending on the set of mounting holes 140, 158, 162, 166 they are received in. The fourth set of mounting holes 166 is illustrated in the end mount 164. The orientation of the fastener 168 with respect to the set of side flanges 118 can be more clearly seen. Again, the fastener 168 passes through the second set of flange holes 132*b* and then the end mount 164 into the fourth set of mounting holes 166.

Figure 11:
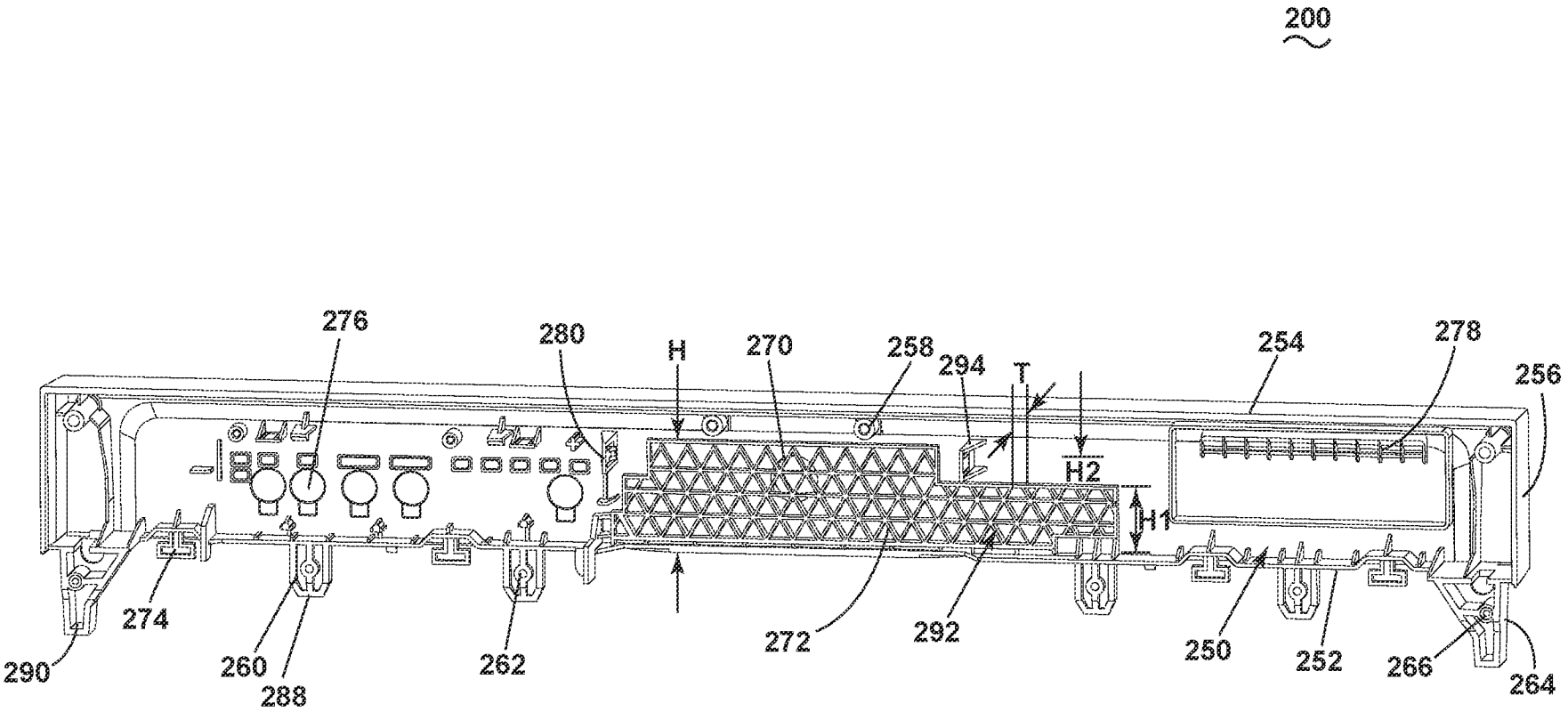
FIG. 11 an enlarged view of a variation of the console from FIG. 4 according to another aspect of the disclosure herein.

FIG. 11 is an enlarged view of a console 200 according to another aspect of the disclosure herein. The console 200 is substantially similar to the console 100, therefore, like parts will be identified with like numerals increased by 100. It should be understood that the description of the like parts of the console 100 applies to the console 200 unless otherwise noted.

A grid structure 270 can have a tessellated pattern in the form of repeated triangles. More specifically the grid structure 270 is an isogrid 292. The isogrid 292 has a raised thickness (T) from an inner console surface 250. The grid structure 270 can extend a length (L) and height (H) along the inner console surface 250. The height (H) of the grid structure 270 can be staggered in a step pattern as illustrated to define a first and second height (H1, H2). The grid structure 270 can be the isogrid 292, the hexagon pattern or a combination of both patterns described herein.

At least one holder 280 can extend from the inner console surface 250. The at least one holder 280 can be a pair of parallel holders 294 for receiving a mounting frame similar in function by variable in structure to the mounting frame 136 already described herein.

Figure 12:
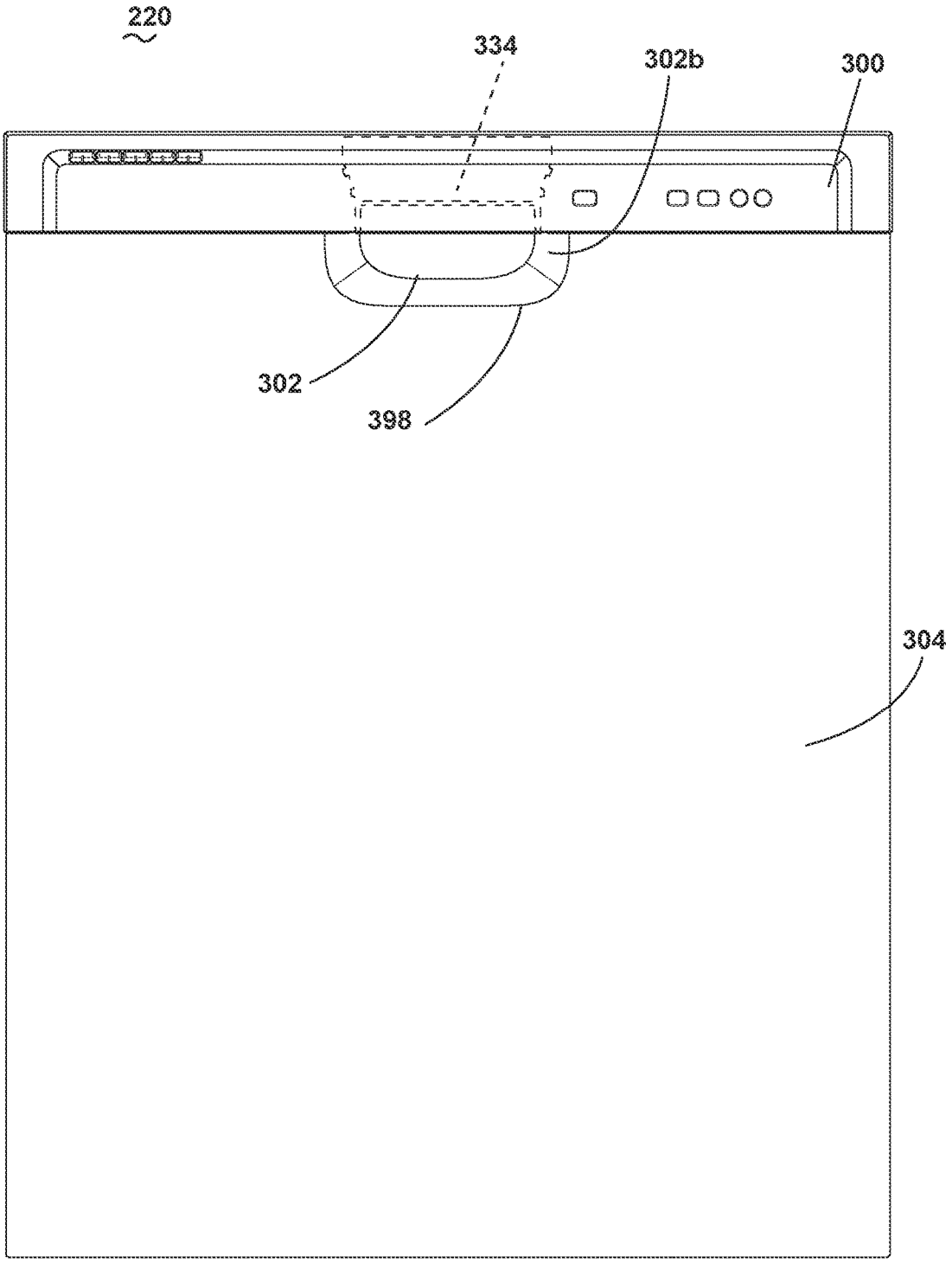
FIG. 12 is a front view of a door assembly for the dishwasher of FIG. 1 according to another aspect of the disclosure herein.

FIG. 12 is a front view of a door assembly 220 according to another aspect of the disclosure herein. The door assembly 220 is substantially similar to the door assembly 20, therefore, like parts will be identified with like numerals increased by 200. It should be understood that the description of the like parts of the door assembly 20 applies to the console door assembly 220 unless otherwise noted.

The door assembly 220 can include, among other things, a console 300, a pocket handle 302, and a door panel 304. Each of the console 300, pocket handle 302, and door panel 304 can be separate pieces coupled to each other during assembly to define the door assembly 220 for accessing the dishwasher 10. The door panel 304 can include an indent 398 for receiving a pocket assembly 334. The pocket assembly 334 can include a pocket portion 302*b* that can define the pocket handle 302. The pocket handle 302 is illustrated as an oblong rounded shape, it should be understood, however, that the pocket handle 302 can be any suitable shape enabling a user to grasp the pocket handle 302 in order to move the door assembly 220 between the opened and closed positions.

Figure 13:
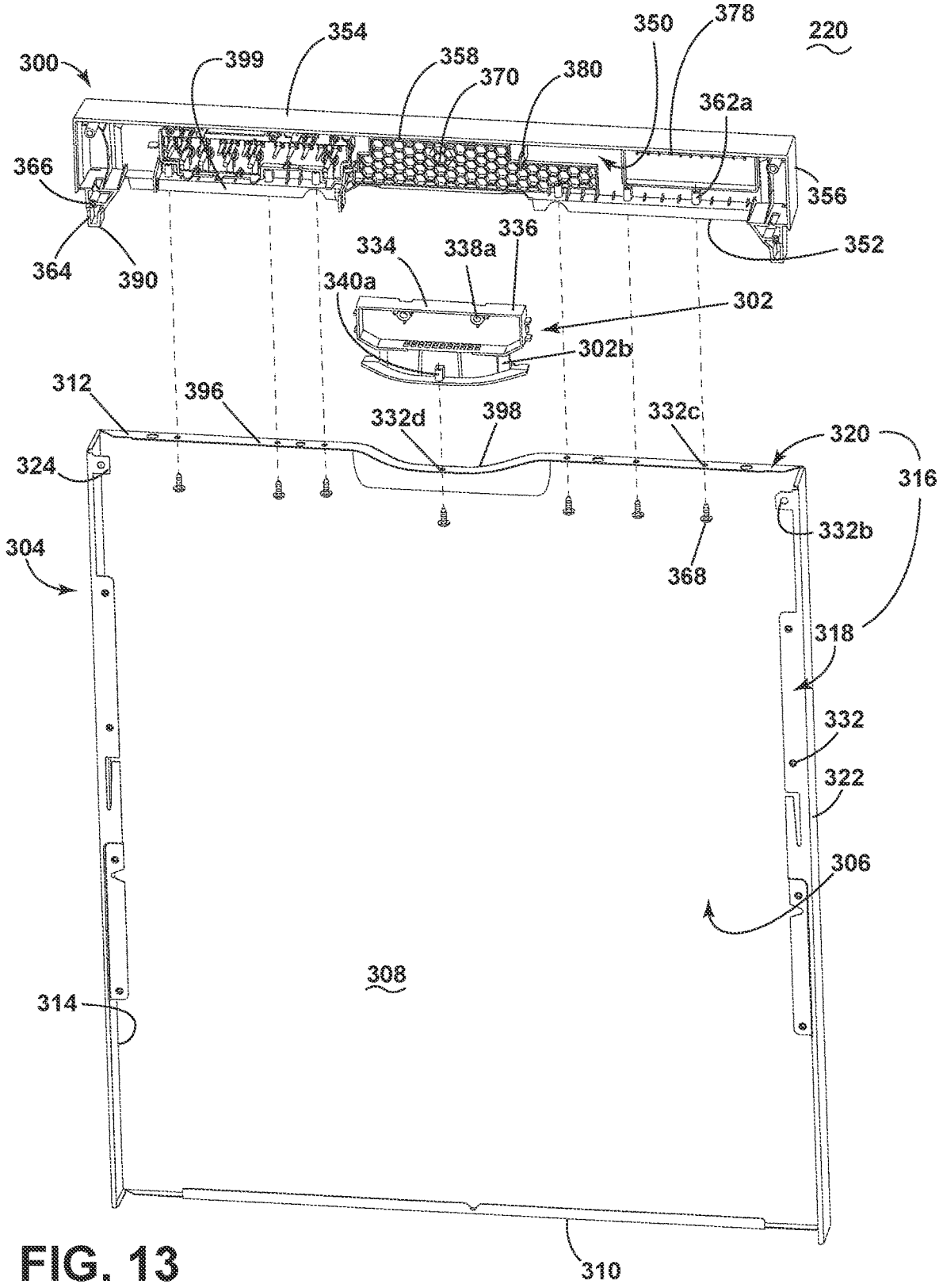
FIG. 13 is an exploded view of the door assembly from FIG. 12 including a door panel, a console, and a pocket handle.

Turning to FIG. 13 an exploded view of the door assembly 220 is illustrated. The pocket handle 302 can be formed in the pocket handle assembly 334. An inner panel surface 306 can span from a bottom of the door panel 304 to a top 312 of the door panel 304 and between opposing sides 314. A set of flanges 316 can extend from the inner panel surface 306 for mounting with other components of the door assembly 220. The set of flanges 316 can include, but is not limited to, a set of side flanges 318 and a set of top flanges 320.

The set of top flanges 320 can include a continuous strip 396 extending toward the treating chamber 16. The continuous strip 396 can extend in a direction generally perpendicular to the plane 308. The continuous strip 396 can be continuously attached to the inner panel surface 306 along an entirety of the top 312 of the door panel 104. The continuous strip 396 can include a third set of flange holes 332*c*. The continuous strip 396 can further include the indent 398 for receiving the pocket handle assembly 334. A fourth set of flange holes 332*d* can be located in the indent 398.

The pocket handle assembly 334 can be a singular piece including a pocket handle portion 302*b*. A fifth set of mounting holes 340*a*, by way of non-limiting example a single mounting hole, can be located at a central bottom portion of the pocket handle portion 302*b*. The fifth set of mounting holes 340*a* is similar in function but different in orientation to the first set of mounting holes 140 described herein. The fifth set of mounting holes 340*a* extend in a direction generally parallel to the plane 308. The pocket handle portion 302*b* can be shaped to mirror the indent 398. A mounting frame 336 can extend upwards from the pocket handle portion 102*a*. A first set of pocket holes 338*a* can be located in an uppermost portion of the mounting frame 336.

The console 300 can include an inner console surface 350. The inner console surface 350 can extend in the same plane 308 as the inner panel surface 306. The inner console surface 350 can span from a bottom 352 of the console 300 to a top 354 of the console 300 and between opposing sides 356 of the console 300. A lip 399 can extend from the inner panel surface 306 and overlay the continuous strip 396 when assembled. A sixth set of mounting holes 362*a* can be located in the lip 399. The sixth set of mounting holes 362*a* is similar in function but different in location to the third set of mounting holes 162 described herein. The sixth set of mounting holes 362*a* extend in a direction generally parallel to the plane 308.

A grid structure 370 can be centrally located along the inner console surface 350. The grid structure can provide structural integrity for the door assembly 220 where the pocket handle 302 is located. While illustrated as similar to the grid structure 170, the grid structure 370 can also be the isogrid 292, the hexagon pattern or a combination of both patterns described herein.

Figure 14:
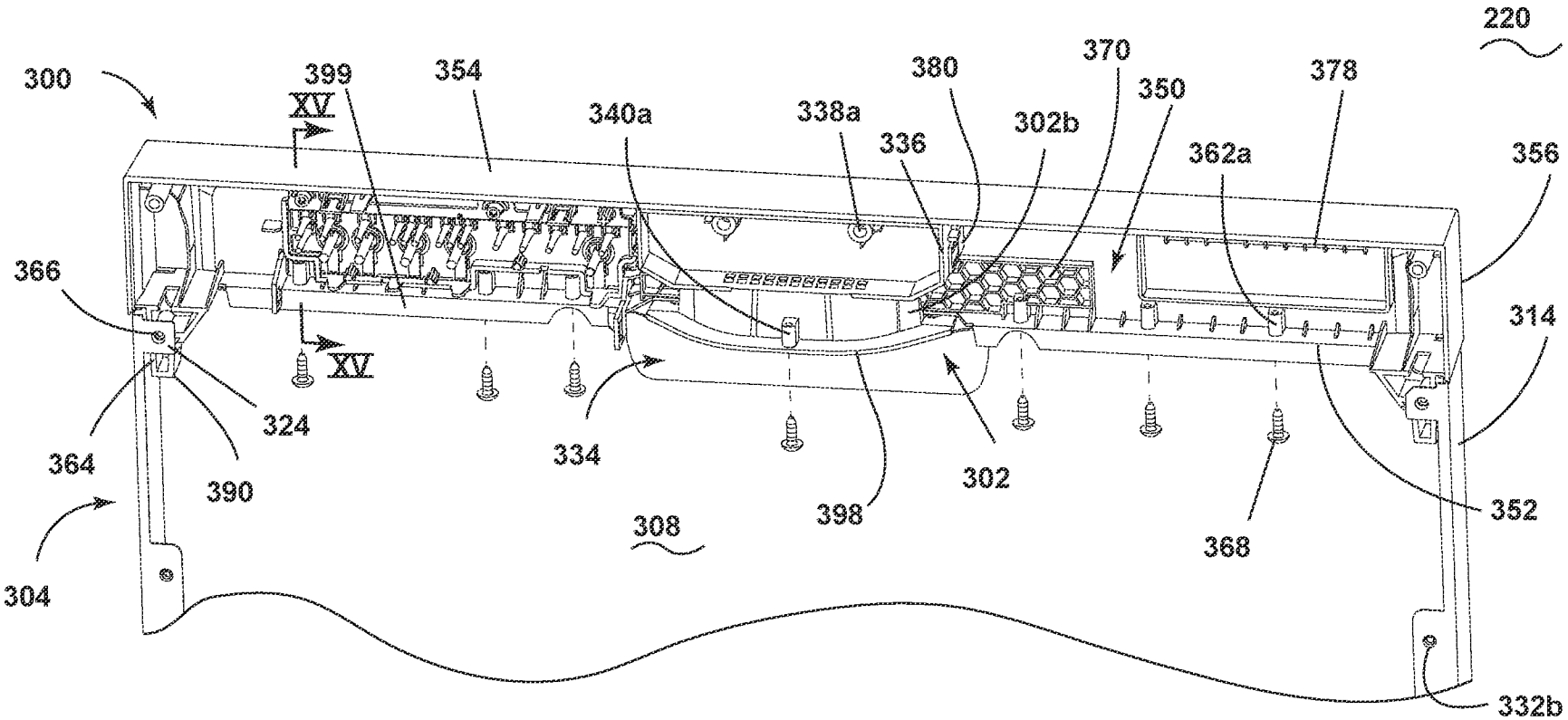
FIG. 14 is an enlarged view of an assembled door assembly from FIG. 13 including the door panel, console, and pocket handle.

Turning to FIG. 14, an enlarged assembled view of the door assembly 220 is illustrated. When assembled, the lip 399 of the console 300 can overlay the continuous strip 396 in such a manner that the third set of flange holes 332*c* line up with the fifth set of mounting holes 362*a*. A suitable fastener 368, by way of non-limiting example a screw, can extend through the third set of flange holes 332*c* and into the sixth set of mounting holes 362*a*. Another suitable fastener 368 can extend through a second set of flange holes 332*b* (FIG. 13) and into a fourth set of mounting holes 366. The pocket handle portion 302*b* can be received in the indent 398. Another suitable fastener 368 can extend through the fourth set of flange holes 332*d* and into the fifth set of mounting holes 340*a*. An additional suitable fastener 168 can extend through the first set of pocket holes 338*a* and into a second set of mounting holes 358 (FIG. 13) located near the top center of the console 300. While each fastener 368 is illustrated as a screw of similar size, it should be understood that the fasteners 368 can be various size and shapes depending on the holes though which they are received. Furthermore, it should be understood that any number of fasteners is contemplated.

Figure 15:
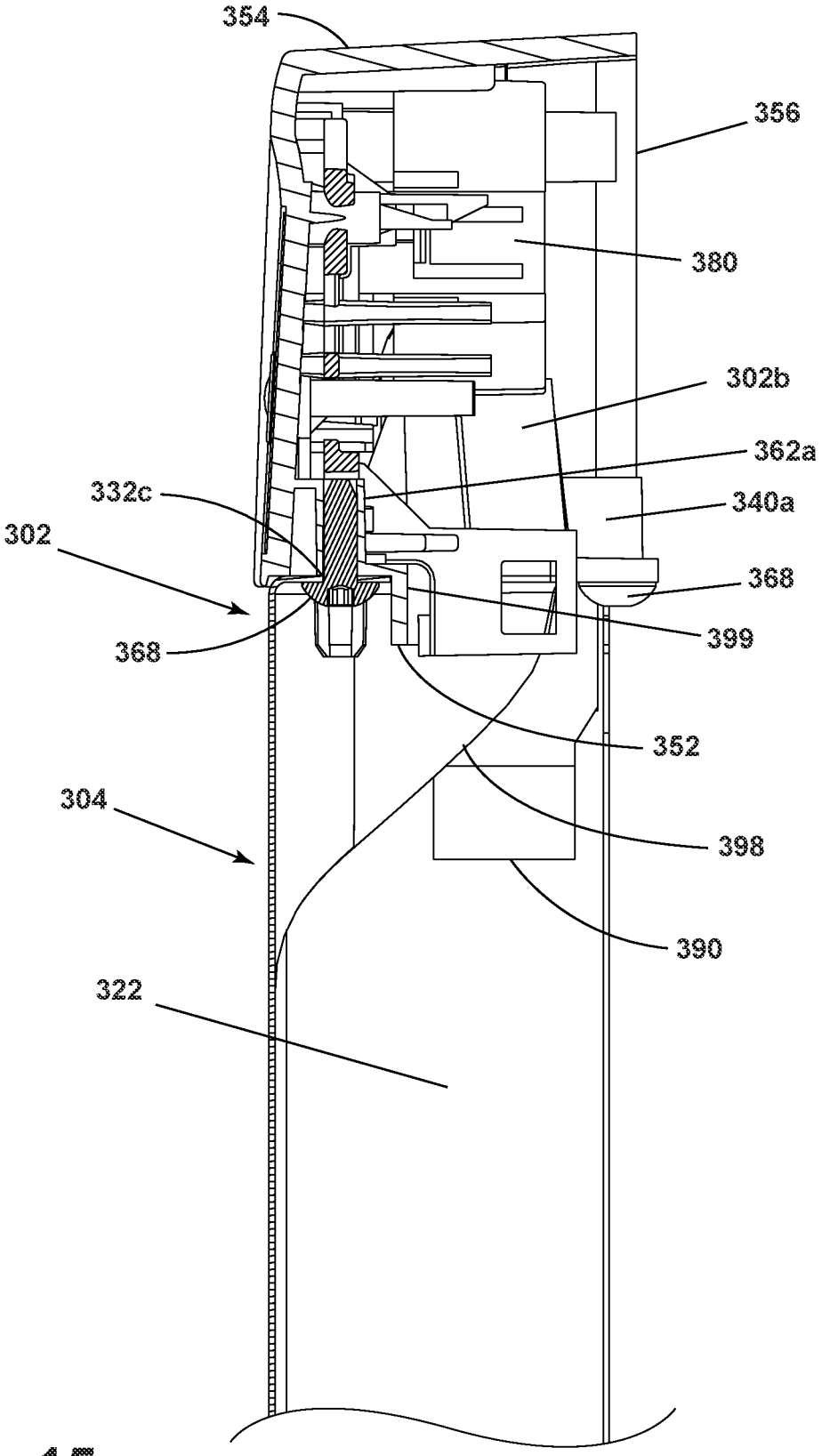
FIG. 15 is a cross-sectional view of the assembled door assembly along line XV-XV from FIG. 14.

FIG. 15 is a cross-sectional view taken along line XV-XV of FIG. 14. The sixth set of mounting holes 362*a* is visible. The indent 398 can more clearly be seen as being a curved portion defining a bottom of the pocket handle 302. The orientation of the fastener 368 with respect to the continuous strip 396 and the lip 399 can more clearly be seen. The fastener 368 passes through the third set of flange holes 332*c* and into the sixth set of mounting holes 362*a*.

Benefits associated with the disclosure described herein include decreasing flex associated with the door panel when opening and closing the door assembly described herein. In decreasing the flex any amount of separation between the various parts is also decreased or becomes zero. Coupling the pocket handle assembly to the console and door panel as described herein increases rigidity. Additionally, adding the grid structure to the console proximate the pocket handle decreases or eliminates flex caused by opening and closing the door assembly when the dishwasher is being used. Furthermore, the grid structure, and in particular the isogrid, increase strength of the door while decreasing or maintaining the weight of the door. Reducing materials used decreasing production cost. Increasing strength and rigidity improve the lifespan of the door assembly.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure. Moreover, while "a set of" various elements have been described, it will be understood that "a set" can include any number of the respective elements, including only one element.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber having an open face for receiving dishes; and a door assembly movable between opened and closed positions, the door assembly comprising:

a door panel having an inner panel surface facing the treating chamber when the door assembly is in the closed position, spanning between a top and a bottom and between opposing sides, and having a set of top flanges extending from the top of the door panel, a pocket handle assembly comprising a pocket handle defining a pocket width and a mounting frame located proximate the top of the door panel for selectively opening and closing the open face of the tub, a console positioned above the set of top flanges when the door assembly is in the closed position such that the console defines a top of the door assembly, the console having at least one tab coupled to the set of top flanges with a fastener, a grid structure integral with and centrally located on the console at a location proximate the pocket handle, the grid structure having one of a hexagon or an isogrid pattern and extending a length equal to or greater than the pocket width, the grid structure commensurate in size with and overlapping with a position of the pocket handle, and a set of fasteners extending through the mounting frame and the console to mount the pocket handle assembly to the console, wherein at least a portion of the mounting frame faces the grid structure.

2. The dishwasher of claim 1, further comprising a pocket tab extending from the pocket handle facing the grid structure and coupled to the console with a fastener.

3. The dishwasher of claim 1, further comprising a set of side flanges including at least one flange extending from at least one of the opposing sides at the top of the door panel.

4. The dishwasher of claim 3 wherein the console further comprises at least one end mount coupled to the at least one flange in the set of side flanges with a fastener.

5. The dishwasher of claim 1 wherein the set of top flanges comprises a J-flange having a first leg extending away from the inner panel surface to a second leg extending parallel to the inner panel surface, the J-flange open to the bottom of the door panel.

6. The dishwasher of claim 5 wherein the first leg includes an opening for receiving the at least one tab and the second leg includes a hole for receiving the fastener in a direction perpendicular to the inner panel surface.

7. The dishwasher of claim 1 wherein the set of top flanges comprise a continuous strip having a perpendicular portion extending perpendicularly away from the inner panel surface.

8. The dishwasher of claim 7 wherein the perpendicular portion includes an opening for receiving the fastener such that the fastener extends parallel to the inner panel surface.

9. The dishwasher of claim 1 further comprising a first set of holes in the mounting frame and a second set of holes in the console, wherein the set of fasteners extend through the first and second set of holes.

10. The dishwasher of claim 1 wherein at least a portion of the mounting frame contacts the grid structure.

11. A dishwasher for treating dishes according to a cycle of operation, the dishwasher comprising:

a tub at least partially defining a treating chamber having an open face for receiving dishes; and a door assembly movable between opened and closed positions, the door assembly comprising:

a door panel having an inner panel surface facing the treating chamber when the door assembly is in the closed position, spanning between a top and a bottom and between opposing sides, and having a set of side flanges extending from at least one of the opposing sides at the top of the door panel, a pocket handle assembly comprising a pocket handle defining a pocket width and a mounting frame located proximate the top of the door panel for selectively opening and closing the open face of the tub, a console positioned above the top of the door panel when the door assembly is in the closed position such that the console defines a top of the door assembly, the console having at least one end mount coupled to the set of side flanges with a fastener, a grid structure integral with and centrally located on the console at a location proximate the pocket handle, the grid structure having one of a hexagon or an isogrid pattern and extending a length equal to or greater than the pocket width, the grid structure having a commensurate surface area with and overlying a position of the pocket handle so as to face the position of the pocket handle, and a set of fasteners extending through the mounting frame and the console to mount the pocket handle assembly to the console, wherein at least a portion of the mounting frame faces the grid structure.

12. The dishwasher of claim 11, further comprising a pocket tab extending from the pocket handle facing the grid structure and coupled to the console with a fastener.

13. The dishwasher of claim 11 wherein the console spans between a top and a bottom and between opposing sides, and further wherein the at least one end mount is a triangular shape end mount extending from the bottom of the console at one of the opposing sides of the console, toward the bottom of the door panel and parallel the opposing sides of the door panel, to define a corner of the triangular shape end mount.

14. The dishwasher of claim 11, further comprising a set of top flanges extending from the top of the door panel.

15. The dishwasher of claim 14 wherein the console further comprises at least one tab coupled to the set of top flanges with a fastener.

16. A dishwasher for treating dishes according to a cycle of operation, the dishwasher comprising:

a tub at least partially defining a treating chamber having an open face for receiving dishes; and a door assembly movable between opened and closed positions, the door assembly comprising:

a door panel having an inner panel surface facing the treating chamber when the door assembly is in the closed position, spanning between a top and a bottom and between opposing sides, a pocket handle assembly comprising a pocket handle defining a pocket width and a mounting frame located proximate the top of the door panel for selectively opening and closing the open face of the tub, a console positioned above the top of the door panel when the door assembly is in the closed position such that the console defines a top of the door assembly, the console coupled to the top of the door panel and comprising an isogrid structure at a location proximate the pocket handle, the isogrid structure extending a length coextensive and overlapping with a position of the pocket width of the pocket handle, and a set of fasteners extending through the mounting frame and the console to mount the pocket handle assembly to the console, wherein at least a portion of the mounting frame faces the isogrid structure.

17. The dishwasher of claim 16 wherein the length of the isogrid structure extends equal to or greater than the pocket width.

18. The dishwasher of claim 16, further comprising a set of flanges extending from at least one of the opposing sides at the top of the door panel.

19. The dishwasher of claim 18, further comprising at least one tab extending from the console and coupled to the set of flanges with a fastener.

20. The dishwasher of claim 16, further comprising a pocket tab extending from the pocket handle facing the isogrid structure and coupled to the console with a fastener.

* * * * *